US009801509B2

(12) United States Patent
Hou

(10) Patent No.: US 9,801,509 B2
(45) Date of Patent: Oct. 31, 2017

(54) TOILET

(71) Applicant: Lan-Chung Hou, Taipei (TW)

(72) Inventor: Lan-Chung Hou, Taipei (TW)

( * ) Notice: Subject to any disclaimer, the term of this patent is extended or adjusted under 35 U.S.C. 154(b) by 60 days.

(21) Appl. No.: 14/886,501

(22) Filed: Oct. 19, 2015

(65) Prior Publication Data

US 2016/0106276 A1 Apr. 21, 2016

(30) Foreign Application Priority Data

Oct. 21, 2014 (CN) ..... 2014 1 0562429

(51) Int. Cl.

| | |
|---|---|
| ***A47K 13/24*** | (2006.01) |
| ***E03D 11/02*** | (2006.01) |
| *E03D 13/00* | (2006.01) |
| *A47K 13/10* | (2006.01) |

(52) U.S. Cl.

CPC ..... *A47K 13/24* (2013.01); *E03D 11/025* (2013.01); *A47K 13/10* (2013.01); *E03D 13/00* (2013.01)

(58) Field of Classification Search

CPC ..... E03D 11/025; E03D 13/00; A47K 13/08; A47K 13/10; A47K 13/24

USPC ..... 4/300.3, 301, 420

See application file for complete search history.

(56) References Cited

U.S. PATENT DOCUMENTS

| | | | | |
|---|---|---|---|---|
| 3,486,172 | A * | 12/1969 | Gleichert | E03D 11/00 4/300.3 |
| 3,614,790 | A * | 10/1971 | Billingsly | E03D 11/00 4/300.3 |
| 4,450,595 | A * | 5/1984 | Saccomanno | E03D 13/00 4/144.1 |
| 5,819,331 | A * | 10/1998 | Miuccio | E03D 13/00 4/242.1 |
| 7,412,732 | B1 * | 8/2008 | Leonard | E03D 9/00 4/300.3 |
| 2006/0260030 | A1 * | 11/2006 | Murray | E03D 9/00 4/300.3 |
| 2008/0244817 | A1 * | 10/2008 | Saller | A47K 13/24 4/300.3 |
| 2009/0106886 | A1 * | 4/2009 | Jung | A47K 13/10 4/246.1 |
| 2015/0040303 | A1 * | 2/2015 | Uhm | E03D 9/00 4/300.3 |

* cited by examiner

*Primary Examiner* — J. Casimer Jacyna
(74) *Attorney, Agent, or Firm* — Muncy, Geissler, Olds & Lowe, P.C.

(57) ABSTRACT

A toilet comprises a toilet body. A water inlet end is disposed at a side of the toilet body. The water inlet end is connected to a water inlet pipe. The toilet body has a frame top, and a groove is formed downwardly along the frame top. A water outlet end is disposed on a bottom of the groove. The water outlet end is connected to a discharge pipe. A frame seat portion is formed at a top of a urinal. A flow deflector is extended downwardly from a back end of the frame seat portion. The frame seat portion is covered onto the frame top, and a front end of the frame seat portion is pivotally connected to a front end of the frame top of the toilet abody.

6 Claims, 6 Drawing Sheets

TOILET

BACKGROUND OF THE INVENTION

Field of Invention

The present invention relates to a toilet and more particularly to a toilet that can be kept clean so as to maintain the hygiene of the bathroom.

Related Art

FIG. 6 shows a conventional toilet being used nowadays. The toilet mainly comprises a toilet body "a", a toilet seat "b", and a water tank "c". The toilet seat b is installed on a top of the toilet body "a". The toilet body "a" structurally includes a ceramic or other materials outer case "a1" and a discharge tube "a2" having a bent drainage pipeline.

When the toilet is being used, it is able for users of both genders to sit on the seat thereof. When male users urinate, they usually lift up the toilet seat and urinate directly into the toilet body. However, not all the male users will lift up the toilet seat and not all of them can urinate into the toilet body accurately. Therefore, urine is often sprinkled on the toilet seat or on the toilet body. It is not only unhygienic, but it also is unsightly and would produce unfavorable urine odor.

In addition, the purpose of providing a bent drainage pipeline disposed inside the outer case of the conventional toilet is to reserve water with a certain height, so as to prevent the bad smell inside an excrement pipe from spreading upward to pollute the air in the bathroom. However, it takes approximately 3 liters of water in order to provide an adequate pressure to flush out the excrement. The water with the excrement is discharged into the excrement pipe by means of the effects produced by gravity and vacuum suction. When large amount of water is discharged, a large quantity of tiny bubbles is formed, and bad odor would be accompanied with the bubbles to spread upward into the air in the bathroom.

SUMMARY OF THE INVENTION

In order to overcome the shortcomings mentioned above, the present invention provides a toilet that is structurally different from the conventional ones.

One object of the present invention is to provide a toilet with an upwardly-liftable urinal disposed on the top of a toilet body in order to prevent male users from urinating on the toilet seat or on the toilet body. Thereby, the toilet can be kept clean, so as to maintain the hygiene of the bathroom.

Another object of the present invention is to provide a toilet with a water outlet end disposed on a toilet body, and with a valve for controlling the amount of water flow directly in order to solve the problems of the requirement of large amount water for discharge and bad odor spreading upwardly in the air. Thereby, it is water-saving and the air in the bathroom can be kept clean and hygienic.

In order to achieve the above-mentioned objects, a toilet of the present invention comprises a toilet body and a urinal. A water inlet end is disposed at a side of the toilet body. The water inlet end is connected to a water inlet pipe. The toilet body has a frame top, and a groove is formed downwardly along the frame top. A water outlet end is disposed on the toilet body. The water outlet end is connected to a discharge pipe. A frame seat portion is formed at a top of the urinal. A flow deflector is extended downwardly from a back end of the frame seat portion. The frame seat portion is covered onto the frame top, and a front end of the frame seat portion is pivotally connected to a front end of the frame top of the toilet body. Thereby, the urinal can be lifted upward to face a user.

In implementation, the water inlet end has a valve for controlling the groove and the discharge pipe to be connected or disconnected with each other.

In implementation, the toilet further comprises an actuating device connected to the frame seat portion for driving the urinal to be lifted upward to face the user.

In implementation, the front end of the frame seat portion and the front end of the frame top of the toilet body are pivotally connected by a pivot. A first gear is disposed at an end of the pivot. The actuating device comprises an actuator and a second gear driven by the actuator. The second gear and the first gear are engaged with each other for driving the urinal to be lifted upward.

In implementation, the actuating device further comprises a connecting element and a pedal connected with each other. The connecting element is connected to an end of the pivot. The pedal is connected to a side of the toilet body, so that it is able for the user to step on the pedal for having the urinal to be lifted upward to face the user when the user stands and faces towards the toilet.

In implementation, a plurality of small inclined holes is disposed around the top of the toilet body. The small inclined holes communicate with the water inlet end for supplying slantingly-flowing water to flush a surface of the flow deflector and flow into the groove of the toilet body.

The present invention will become more fully understood by reference to the following detailed description thereof when read in conjunction with the attached drawings.

DETAILED DESCRIPTION OF THE INVENTION

Figure 1:
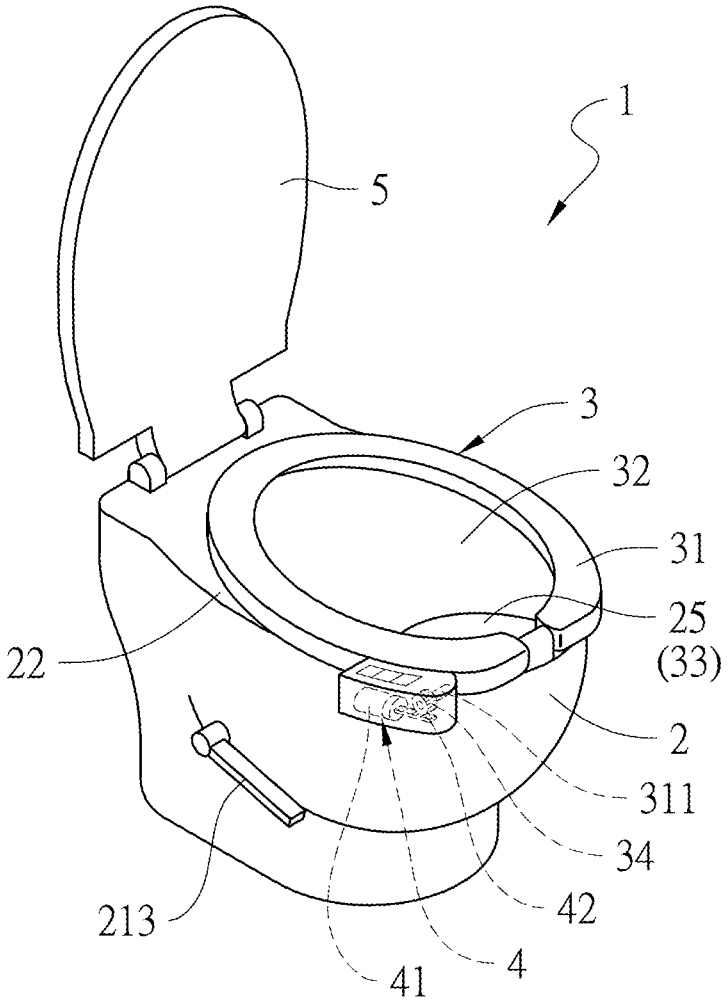
FIG. 1 is a perspective view of a preferred embodiment of a toilet according to the present invention.
Figure 2:
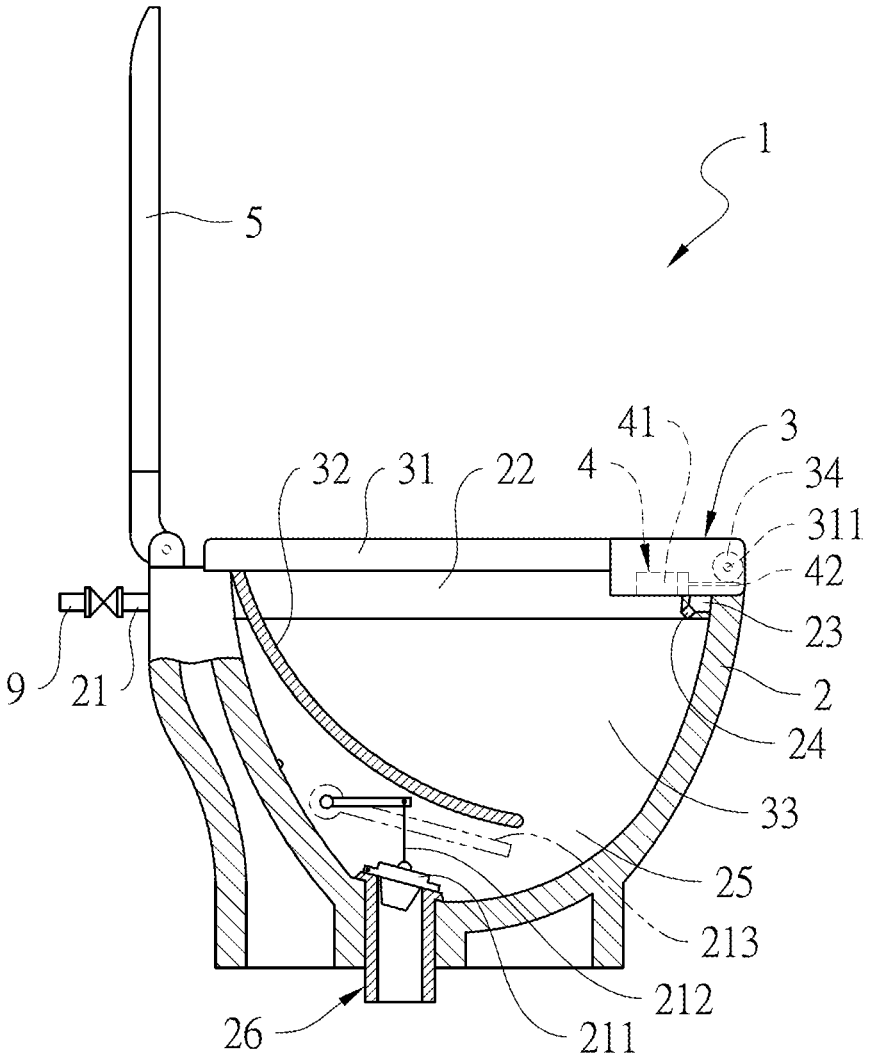
FIG. 2 is a sectional view showing the preferred embodiment of the assembled toilet according to the present invention.

Please refer to FIGS. 1 and 2 showing a preferred embodiment of a toilet 1 according to the present invention. The toilet 1 mainly comprises a toilet body 2, a urinal 3, and an actuating device 4. A toilet seat 5 is covered onto the toilet body 2 and the urinal 3.

The toilet body 2 is positioned at a location above a discharge pipe. In general, an end of the toilet body 2 is located close to a wall. A water inlet pipe 9 is embedded in the wall for supplying water into the toilet body 2. In this embodiment, the end of the toilet body 2 close to the wall is defined to be a back end, and another end of the toilet body 2 far away from the wall is defined to be a front end. A water inlet end 21 is disposed at the back end of the toilet body 2. The water inlet end 21 is connected to the water inlet pipe 9. A frame top 22 is disposed at a top of the toilet body 2. A frame-shape water passage 23 is disposed under the frame top 22. The water passage 23 and the water inlet end 21 are connected with each other, so as to form a water-flowing pipeline. A plurality of small downwardly-inclined holes 24, facing towards the back end of the toilet body 2, is disposed on the peripheries of the frame top 22. The small inclined holes 24 are disposed in the region of the water-flowing pipeline and in connection with the water inlet end 21, so as to supply slantingly-ejecting water flow towards the back end of the toilet body 2. Furthermore, a groove 25 is formed downwardly along the frame top 22. A water outlet end 26 is disposed on a bottom of the groove 25. The water outlet end 26 is connected to the discharge pipe.

The water inlet end 21 has a valve 211. The valve 211 is connected via a rope 212 to a handle 213 disposed at an outer side of the toilet body 2. Normally, the water outlet end 26 is closed by the valve 211 to have the groove 25 and the discharge pipe disconnected, so as to prevent the water in the groove 25 from flowing downward. When a user pulls the handle 213, the valve 211 is opened, so as to have the groove 25 on the inner side of the toilet body 2 and the discharge pipe connected.

The urinal 3 has a top formed as a frame seat portion 31. A curved flow deflector 32 is extended downwardly from a back end of the frame seat portion 31. A space 33 is formed under the peripheries of the curved flow deflector 32 and the front end of the frame seat portion 31. The frame seat portion 31 is covered onto the frame top 22 of the toilet body 2. The front end of the frame seat portion 31 is pivotally connected with the front end of the frame top 22 of the toilet body 2 via a pivot 311. The front end of the frame seat portion 31 is connected with the pivot 311. An end of the pivot 311 is pivotally connected with a horizontal gear. The horizontal gear is used as a first gear 34.

The actuating device 4 is disposed at a side of the frame top 22 of the toilet body 2. The actuating device 4 comprises an electromagnetic valve and a gear rack. The electromagnetic valve is used as an actuator 41. The gear rack is used as a second gear 42. An end of the gear rack is connected with the electromagnetic valve. Another end of the gear rack is engaged with the horizontal gear. Thereby, when the electromagnetic valve drives the gear rack to move the horizontal gear forward or backward, the frame seat portion 31 and the pivot 311 would rotate simultaneously, so as to lift the urinal 3 upward by using the pivot 311 as a shaft. In implementation, the actuator 41 also can be a servo motor or a motor with a speed-down mechanism. The first gear 34 and the second gear 42 are bevel gears. Accordingly, when the actuator 41 drives the second gear 42 to drive the first gear 34, the urinal 3 could be lifted upward as well.

Figure 3:
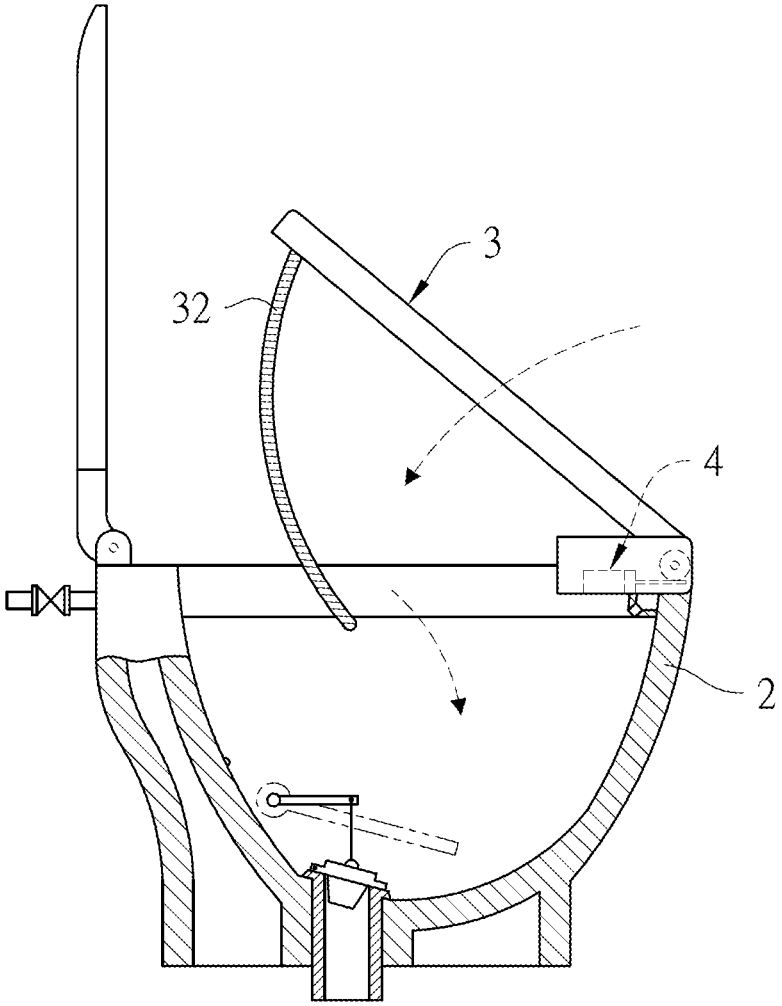
FIGS. 3 and 4 are sectional views showing the use of the preferred embodiment of the toilet according to the present invention.
Figure 4:
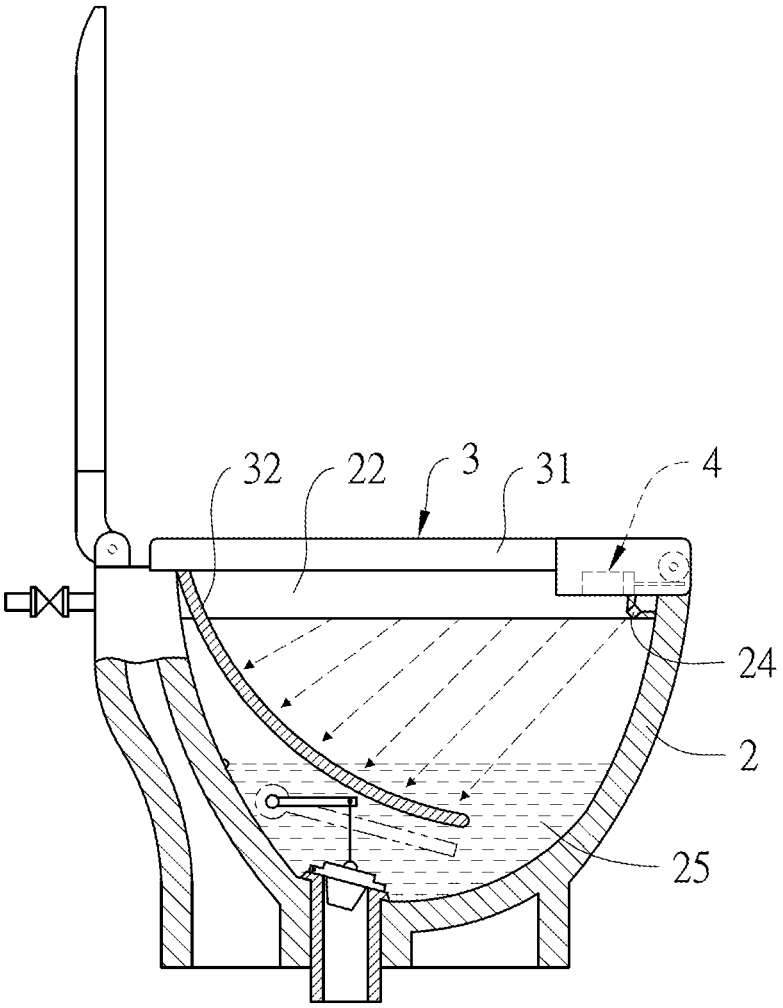

As shown in FIG. 3, when the user stands in front of the front end of the toilet body 2 and controls the actuating device 4 to lift the urinal 3 upward facing towards the user, it would be convenient for the user to urinate on the flow deflector 32 since the distance between the urinal 3 and the user is shortened. As shown in FIG. 4, when the user controls the actuating device 4 to move the urinal 3 downward to have the frame seat portion 31 of the urinal 3 covered onto the frame top 22 of the toilet body 2 and to place the flow deflector 32 inside the groove 25 of the toilet body 2, through the small inclined holes 24 on the top of the toilet body 2 water would be slantingly ejected to flush the urine on the surface of the flow deflector 32 into the groove 25 of the toilet body 2.

Figure 5:
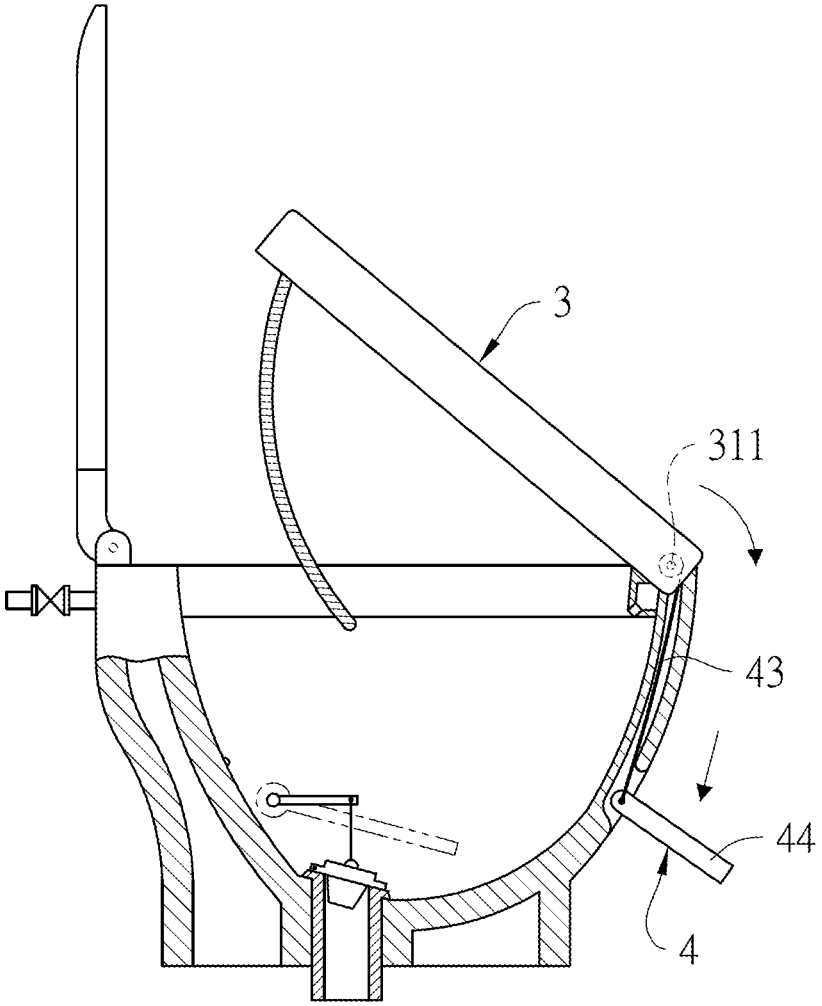
FIG. 5 is a sectional view showing the use of the preferred embodiment of the toilet using another actuating device according to the present invention.
Figure 6:
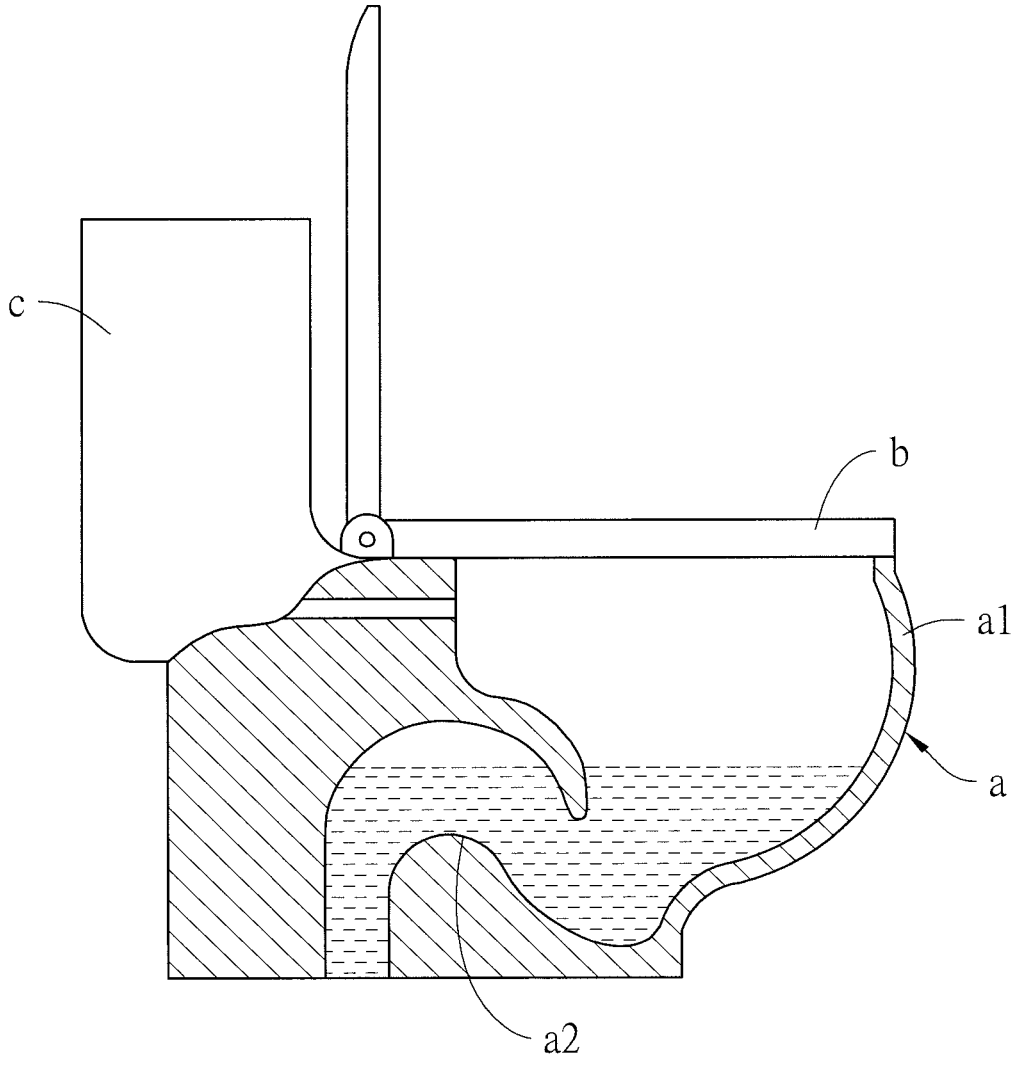
Fig. 6 (Prior Art)
FIG. 6 is a sectional view showing a conventional toilet.

As shown in FIG. 5, another kind of actuating device 4 is used. The actuating device 4 comprises a connecting element 43 and a pedal 44 connected with each other. The connecting element 43 is a rope. In implementation, the connecting element 43 also can be a connecting rod. The connecting element 43 is connected to an end of the pivot 311. The pedal 44 is connected to the outer side of the toilet body 2. Thereby, when the user is standing and facing towards the toilet and stepping on the pedal 44, the urinal 3 would be lifted upward to face the user.

Therefore, the toilet of the present invention has the following advantages:

1. The toilet of the present invention enables a user to lift the urinal upward by hand, foot, or other mechanical means to have the urinal faced the user. Therefore, it could prevent the spreading of the urine on the toilet seat or on the toilet body, so that it is able to keep the toilet clean and maintain the hygiene of the bathroom.

2. According to the present invention, when the frame seat portion of the urinal is covered onto the frame top of the toilet body, water could be slantingly ejected onto the flow deflector, so as to keep the flow deflector clean.

3. According to the present invention, the valve is used to control the water flowing or to enclose the water outlet. Therefore, it is able to save water effectively and keep the air in the bathroom clean and hygienic.

Therefore, based on the disclosure mentioned above, the present invention can achieve the expected objects to keep the toilet clean, to save water effectively, and to keep the air in the bathroom clean and hygienic.

Although the embodiments of the present invention have been described in detail, many modifications and variations may be made by those skilled in the art from the teachings disclosed hereinabove. Therefore, it should be understood that any modification and variation equivalent to the spirit of the present invention be regarded to fall into the scope defined by the appended claims.

What is claimed is:

1. A toilet comprising:

a toilet body, having a water inlet end disposed at a side of the toilet body and connected to a water inlet pipe; the toilet body having a frame top, a groove being formed downwardly along the frame top, and a water outlet end being disposed on the toilet body and connected to a discharge pipe; and a urinal, having a frame seat portion formed at a top of the urinal, and a flow deflector being extended downwardly from a back end of the frame seat portion; the frame seat portion being covered onto the frame top and having a front end pivotally connected to a front end of the frame top of the toilet body, so as to have the urinal lifted upward to face a user;

wherein the front end of the frame seat portion and the front end of the frame top of the toilet body is defined to be near the user while the back end of the frame seat portion is defined to be away from the user and opposite to the front end of the frame seat portion; and wherein the flow deflector is moved into the toilet body when the frame seat portion of the urinal is covered onto the frame top and is moved out of the toilet body when the frame seat portion of the urinal is lifted upward.

2. The toilet as claimed in claim 1, wherein the water inlet end has a valve for controlling the groove and the discharge pipe to be connected or disconnected with each other.

3. The toilet as claimed in claim 1, further comprising an actuating device connected to the frame seat portion for driving the urinal to be lifted upward to face the user.

4. The toilet as claimed in claim 3, wherein the front end of the frame seat portion and the front end of the frame top of the toilet body are pivotally connected by a pivot, and the pivot is provided with a first gear at an end thereof; the actuating device comprises an actuator and a second gear driven by the actuator, and the second gear and the first gear are engaged with each other for driving the urinal to be lifted upward.

5. The toilet as claimed in claim 3, wherein the front end of the frame seat portion and the front end of the frame top of the toilet body are pivotally connected by a pivot; the actuating device comprises a connecting element and a pedal connected with each other; the connecting element is connected to an end of the pivot; the pedal is connected to a side of the toilet body, so that it is able for the user to step on the pedal for having the urinal to be lifted upward to face the user when the user stands and faces towards the toilet.

6. The toilet as claimed in claim 1, wherein a plurality of small inclined holes is disposed around the top of the toilet body; the small inclined holes communicate with the water inlet end for supplying slantingly-flowing water to flush a surface of the flow deflector and flow into the groove of the toilet body.

* * * * *